US008644539B2

(12) United States Patent
Zhu et al.

(10) Patent No.: US 8,644,539 B2
(45) **Date of Patent: *Feb. 4, 2014**

(54) HEARING AID HAVING IMPROVED RF IMMUNITY TO RF ELECTROMAGNETIC INTERFERENCE PRODUCED FROM A WIRELESS COMMUNICATIONS DEVICE

(75) Inventors: Lizhong Zhu, Waterloo (CA); George Soliman Mankaruse, Kitchener (CA); Michael Stephen Corrigan, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/572,985

(22) Filed: Aug. 13, 2012

(65) Prior Publication Data

US 2012/0308061 A1 Dec. 6, 2012

Related U.S. Application Data

(63) Continuation of application No. 12/725,764, filed on Mar. 17, 2010, now Pat. No. 8,265,312, which is a continuation of application No. 11/289,902, filed on Nov. 30, 2005, now Pat. No. 7,715,578.

(51) Int. Cl.
*H04R 25/00* (2006.01)

(52) U.S. Cl.
USPC ..... 381/317; 381/312

(58) Field of Classification Search
USPC ..... 381/312, 317, 322, 324
See application file for complete search history.

(56) References Cited

U.S. PATENT DOCUMENTS

| | | | | |
|---|---|---|---|---|
| 5,640,457 | A * | 6/1997 | Gnecco et al. | 381/322 |
| 5,819,162 | A | 10/1998 | Spann et al. | |
| 6,104,821 | A | 8/2000 | Husung | |
| 6,473,512 | B1 | 10/2002 | Juneau et al. | |
| 6,546,109 | B1 | 4/2003 | Gnecco et al. | |
| 7,106,876 | B2 * | 9/2006 | Santiago | 381/369 |
| 2003/0123681 | A1 | 7/2003 | Furst et al. | |
| 2004/0252812 | A1 | 12/2004 | Waldron et al. | |
| 2005/0117713 | A1 | 6/2005 | Waldron et al. | |

FOREIGN PATENT DOCUMENTS

| | | |
|---|---|---|
| DE | 19602453 | 7/1997 |
| DE | 19724491 | 7/1998 |
| EP | 0500988 | 9/1992 |

* cited by examiner

*Primary Examiner* — Brian Ensey
(74) *Attorney, Agent, or Firm* — Allen, Dyer, Doppelt, Milbrath & Gilchrist, P.A. Attorneys at Law

(57) ABSTRACT

A hearing aid has improved immunity to RF electromagnetic interference produced from wireless communications devices. A microphone receives audio signals from the environment. Audio circuitry is connected to the microphone and amplifies the audio signals. A speaker is connected to the audio circuitry and directs the audio signals into an ear canal of the user of the hearing aid. The audio connection lines connect the microphone and audio circuitry and the speaker and audio circuitry. A filter is connected into each of the audio connection lines and operative for reducing the RF coupling from a wireless communications device.

26 Claims, 4 Drawing Sheets

HEARING AID HAVING IMPROVED RF IMMUNITY TO RF ELECTROMAGNETIC INTERFERENCE PRODUCED FROM A WIRELESS COMMUNICATIONS DEVICE

This application is a continuation of Ser. No. 12/725,764 filed Mar. 17, 2010, now U.S. Pat. No. 8,265,312 issued Sep. 11, 2012 which, in turn, is a continuation of Ser. No. 11/289,902 filed Nov. 30, 2005 now U.S. Pat. No. 7,715,578 issued May 11, 2010, all of which are hereby incorporated herein in their entireties by reference.

FIELD OF THE INVENTION

This invention relates to hearing aids, and more particularly, this invention relates to hearing aids that include filters for improving RF immunity to RF electromagnetic interference.

BACKGROUND OF THE INVENTION

When some mobile wireless communications devices or other wireless communications devices are used near some hearing aid devices, for example, a cochlear implant or a behind-the-ear (BTE) hearing aid having a tone hook and earmold, users often detect a buzzing, humming or whining noise, or other unwanted audible noise such as a Global System for Mobile communications (GSM) buzz, which can be annoying to users. Some hearing aids are more immune than others and have appropriate filters for suppressing this interference noise, while some phones vary in the amount of interference they generate.

The wireless telephone industry has developed ratings for some mobile phones to assist hearing aid users in finding a phone that is more compatible with their hearing aid. Not all phones have been rated, however, but typically, a phone should have a rating listed on its box or on a label on the box. These ratings are not guarantees and some results vary depending on the type of hearing aid and user hearing loss. Some ratings use an M-ratings scale with phones rated M3 or M4 meeting FCC requirements that are likely to generate less interference to hearing aids than phones that are not labeled. M4 is a higher rating. A T-ratings scale occurs with phones rated T3 or T4 meeting FCC requirements, and likely to be useable with a hearing aid telecoil ("T-switch" or "telephone switch") than unrated phones. T4 is the better quality. Some hearing aid devices, however, do not include telecoils. Also, some hearing aids can be measured for immunity to this type of interference.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
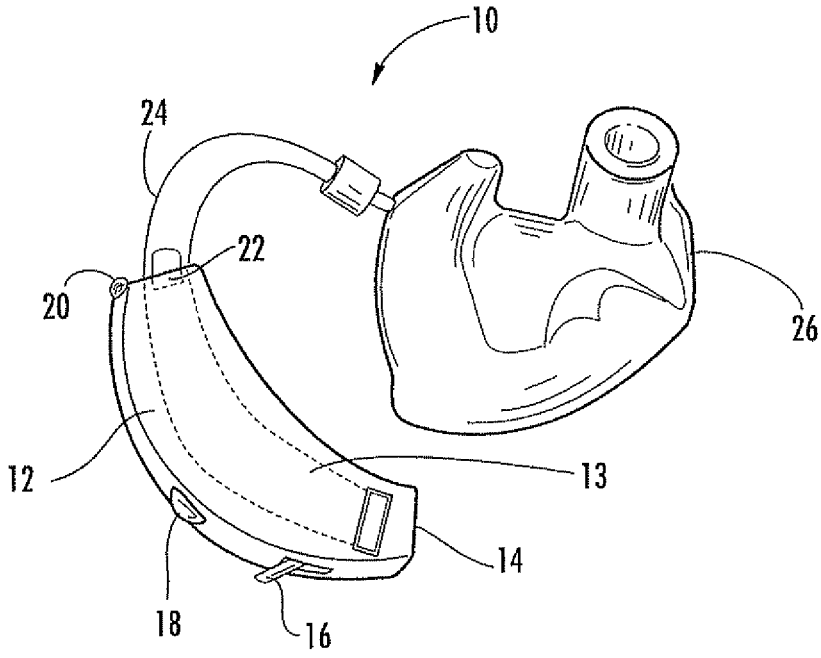
FIG. 1 is a perspective view of a behind-the-ear (BET) hearing aid that includes an earmold for ear insertion with the audio circuitry and other components, including a filter for reducing RF electromagnetic interference produced from a wireless communications device.

Different embodiments will now be described more fully hereinafter with reference to the accompanying drawings, in which preferred embodiments are shown. Many different forms can be set forth and described embodiments should not be construed as limited to the embodiments set forth herein. Rather, these embodiments are provided so that this disclosure will be thorough and complete, and will fully convey the scope to those skilled in the art. Like numbers refer to like elements throughout, and prime notation is used to indicate similar elements in alternative embodiments.

The embodiments as described address the RF interference produced from a wireless communications device, for example, a cellular phone to a hearing aid. This interference can cause unwanted audible noise, such as GSM buzz, which can be annoying to users. Currently, cell phone manufacturers are required to meet the Federal Communications Commission (FCC) requirements for hearing aid compatibility (HAC). The embodiments as described target the hearing aid side of the problem instead of concentrating on cell phone compatibility.

In accordance with one non-limiting example, RF filters and RF shielding techniques can be implemented in a microphone circuit or speaker of a hearing aid. These types of filters and shielding can also be supplied to a power supply circuit and other circuits in a hearing aid to reduce the RF coupling from the wireless communications device to those circuits in the hearing aid, causing an audible unwanted noise, such as GSM buzz.

In accordance with one non-limiting embodiment, the hearing aid has improved immunity to RF electromagnetic interference produced from wireless communications devices, for example, cellular telephones. A microphone receives audio or acoustic signals from the environment. Audio circuitry is connected to the microphone and amplifies the audio signals. A speaker is connected to the audio circuitry and directs the audio or acoustic signals into an ear of a user using the hearing aid. Audio connection lines connect the microphone and audio circuitry and the speaker and audio circuitry. A filter is connected into each of the audio connection lines and operative for reducing the RF coupling from a wireless communications device.

In another aspect, a filter is serially connected into each audio connection line and can be formed as a ferrite inductor or ferrite bead. The filter could be formed as an LC filter serially connected into each audio connection line. A second filter element could be connected into the audio connection line that is connected to the speaker, and serially connected to another filter. The second filter element could be formed as a ferrite inductor.

In yet another aspect, an RF shield could surround one of at least a speaker or microphone to aid in reducing the RF coupling from a wireless communications device. The RF shield could be formed as a metallic housing. A hearing aid housing could support the microphone, speaker and audio circuitry. A tone hook could be connected to the hearing aid housing for receiving audio signals from the speaker. An earmold could be connected to the tone hook and adapted to be inserted within the ear of a user.

In yet another aspect, a microphone bias line connects the microprocessor and microphone for carrying microphone bias control signals between the microprocessor and the microphone. A microphone bias filter is connected into each of the microphone bias lines for reducing the RF coupling from a wireless communications device. A method aspect is also set forth.

As is known to those skilled in the art, a typical hearing aid includes a microphone, amplifier, volume control, an earphone (receiver), power source, and some type of coupling to the ear such as an earmold. The microphone takes the incoming signal and filters it to provide a respective frequency response. Amplifiers take the resulting signal and make it louder. A receiver converts the signal back into an acoustical form of the signal that the ear can hear.

A hearing aid is shown in FIG. 1 at 10 and designed and configured as a behind-the-ear (BTE) hearing aid. It should be understood that all different types of hearing aids can be used with the RF filtering as will be described, including hearing aids that are inserted directly into the ear canal of a user, for example, a cochlear implant, or supported by the ears as shown in the BTE hearing aid of FIG. 1.

The hearing aid 10 typically includes a hearing aid housing 12, having audio circuitry within the housing and indicated by a dashed line at 13, and a battery compartment 14 for holding a battery for powering the audio circuitry. An on/off switch 16 allows on/off operation to be user controlled. A volume control 18 allows user control over the amount of amplification or sound amplitude heard through the ear. The microphone 20 and speaker 22 are shown at an end of the hearing aid. A tone hook 24 extends from the speaker 22 and includes an earmold 26 connected thereto that has a hearing insert that is adapted to be inserted within the ear canal of a user.

Figure 2:
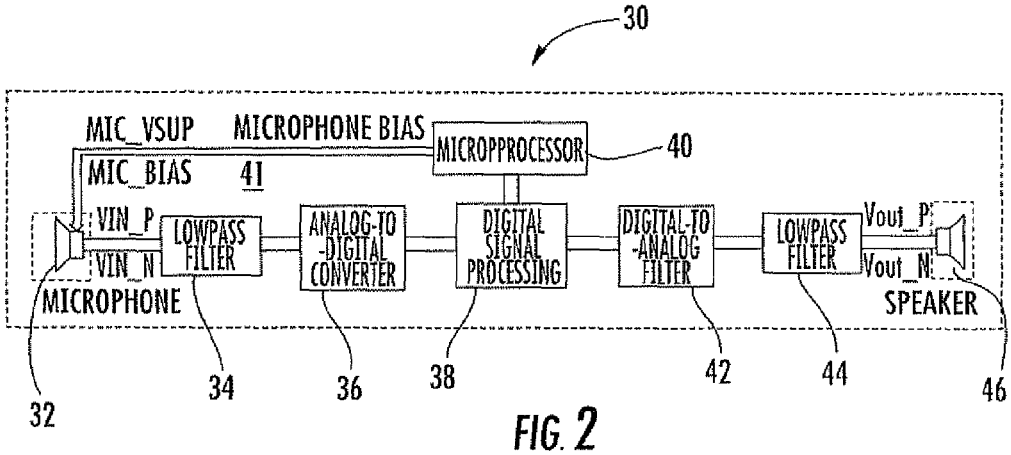
FIG. 2 is a block diagram showing basic functional components of a hearing aid that could be adapted to incorporate a filter to decrease unwanted audible noise, such as GSM buzz, and any electromagnetic interference produced from a wireless communications device.

FIG. 2 is a block diagram of a typical hearing aid 30, including the microphone 32 that receives acoustical or audio signals from the environment. The analog voltage signals produced at the microphone by the transducer as Vin_P and Vin_N signals are input into a low pass filter 34 and digitally converted by an analog-to-digital converter 36 after low pass filtering. After conversion, the digital signals are processed at a digital signal processor (DSP) 38 with standard digital signal processing techniques. A microprocessor 40 is operative with the DSP 38 and the microprocessor transmits microphone bias control signals over microphone bias lines as a microphone bias (MIC_BIAS) and supplementary microphone voltage (MIC_VSUP) line. Signals are transferred back to the microphone in a closed loop system as illustrated at 41 in FIG. 2. After digital signal processing at DSP 38, the digital signal is processed in a digital-to-analog filter 42 and filtered in a low pass filter 44. The voltage signals from the low pass filter 44 as Vout_P and Vout_N are transferred to the speaker 46, which could be connected to an earmold that is inserted within the ear or as part of a cochlear implant or BTE hearing aid.

Figure 3:
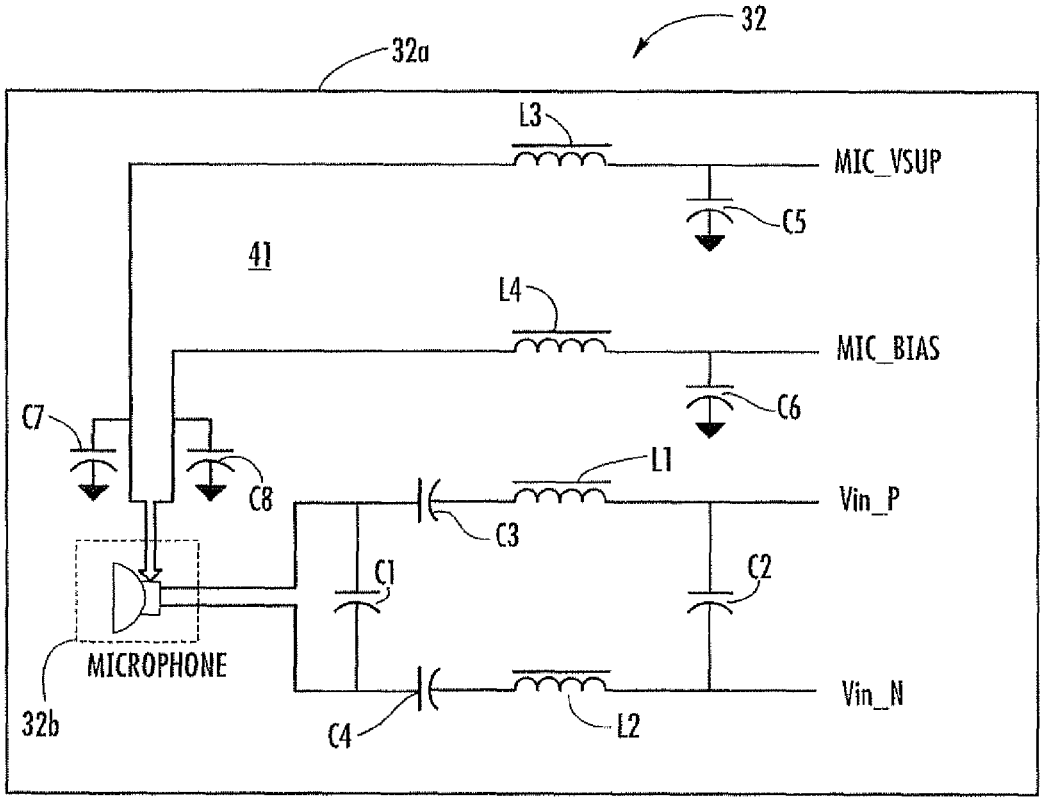
FIG. 3 is a schematic circuit diagram showing a combination microphone and filter circuit, which could be incorporated into the microphone shown in FIG. 2.
Figure 4:
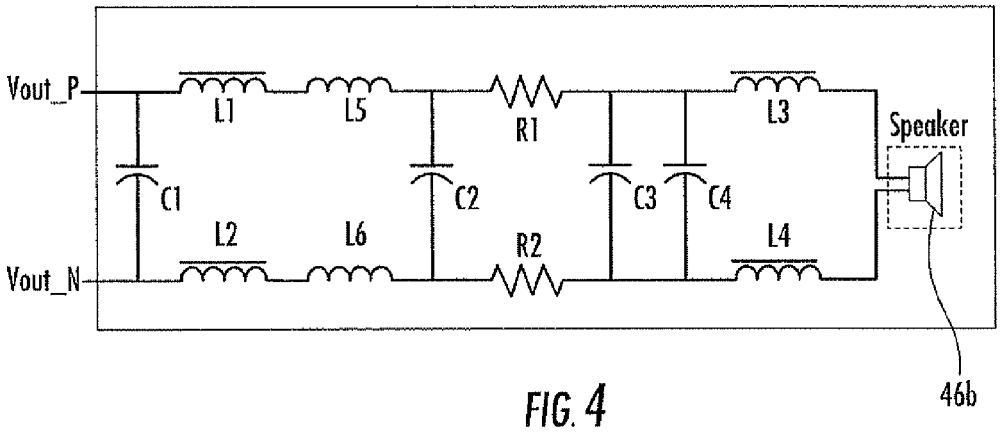
FIG. 4 is a schematic circuit diagram showing a combination speaker and filter circuit, which could be incorporated into the speaker shown in FIG. 2.

FIGS. 3 and 4 illustrate the type of electromagnetic interference (EMI) filters that can be used with the microphone 32 (FIG. 3) and the speaker 46 (FIG. 4). As shown in FIG. 3, the microphone is formed as an overall microphone circuit 32 having an output into the low pass filter 34 as Vin_P and Vin_N, and four capacitors C1, C2, C3, C4 and two inductors L1, L2. A first and second capacitor C1, C2 are connected parallel into the Vin_P and Vin_N lines. Serially connected capacitors C3, C4 and inductors L1, L2 are connected in each line. A feedback circuit from the microprocessor as a microphone bias line includes an inductor L3, L4 and grounded capacitor C5, C6 in each line, followed by another grounded capacitor C7, C8 in each line as it enters the microphone as illustrated. The entire circuit as described could be enclosed with an RF shield 32*a*, or just the transducer area of the microphone shown by the dashed lines 32*b*.

FIG. 4 shows a filter for the speaker illustrating the Vout_P and Vout_N audio connection lines. Each line includes serially connected ferrite inductor elements L1, L2, L3 and L4, resistor elements R1, R2, and non-ferrite inductor elements L5, L6. Four parallel capacitors C1, C2, C3 and C4 are connected as illustrated. The ferrite inductors L1, L2, L3 and L4 can be formed as a ferrite bead. The non-ferrite inductor L5, L6 in each line can be formed as a 680 microhenry inductor in one non-limiting example. The resistors R1, R2 can be 28 ohm resistors in one non-limiting example. The capacitors C2 and C3 could be 1.5 and 0.68 microhenry capacitors in one non-limiting example.

The RF filters as described could be RF ferrite beads, serially connected inductors, or shunt capacitors or a combination of both. In another aspect, an isolation RF shield as a "can" could surround and isolate the microphone or speaker from radiating energy depending on the design, whether the whole circuit as shown at 32*a* and 46*a* or the transducer at 32*b* and 46*b* in FIGS. 3 and 4.

Different types, sizes and shapes of ferrite beads can be used. Typically, a ferrite bead is formed from a material having a permeability controlled by the composition of the different oxides, for example, a ferric oxide, sometimes with nickel and zinc added. The ferrite beads can sometimes be formed as ferrite sleeves with two half parts that are added onto a signal line or a solder overcoat on a signal trace. Typically, the longer the bead, the better the RF suppression. The bead equivalent circuit can be a series resistor and inductor.

Many of the illustrated components of FIGS. 2-4 can be formed as an integrated circuit or contained within a housing or contained on a dielectric substrate, i.e., a circuit board. A circuit board could refer to any dielectric substrate, PCB, ceramic substrate or other circuit carrying structures for carrying signal circuits in electronic components. A battery (not illustrated) could be included within any housing for the earphone.

It should be understood that the RF and EMI filters as described relative to FIGS. 2-4 can be used in many different types of hearing aids. It should be understood that many different types of hearing aid designs can be used because of the nature of hearing losses that occur for humans such as explained with reference to FIGS. 5 and 6.

Figure 5:
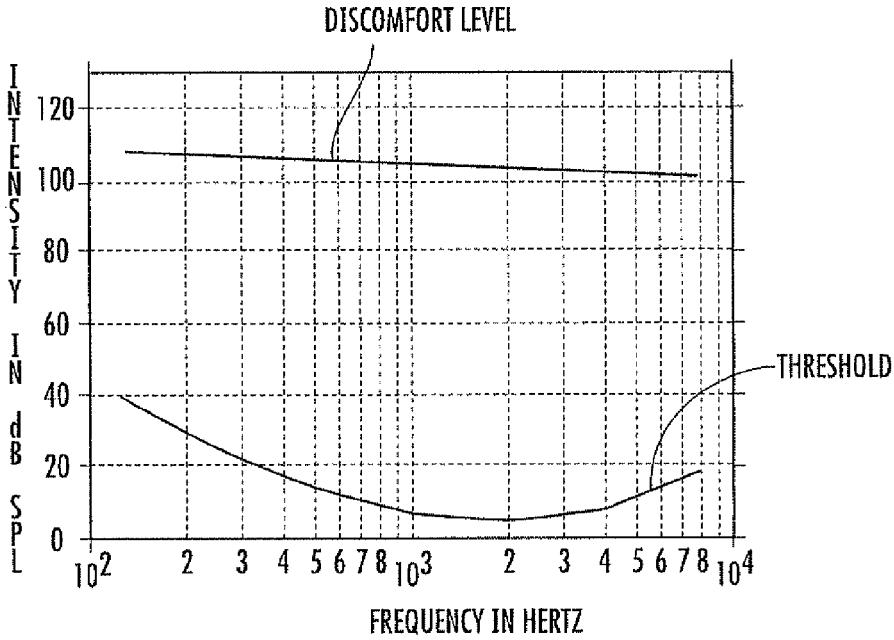
FIG. 5 is a graph showing a threshold of hearing and discomfort for a typical normal ear.

FIG. 5 shows a threshold of hearing as a function of frequency for a person with normal hearing and a threshold of discomfort as a function of frequency. Any sounds that extend beyond the threshold are painful and sometimes harmful.

Figure 6:
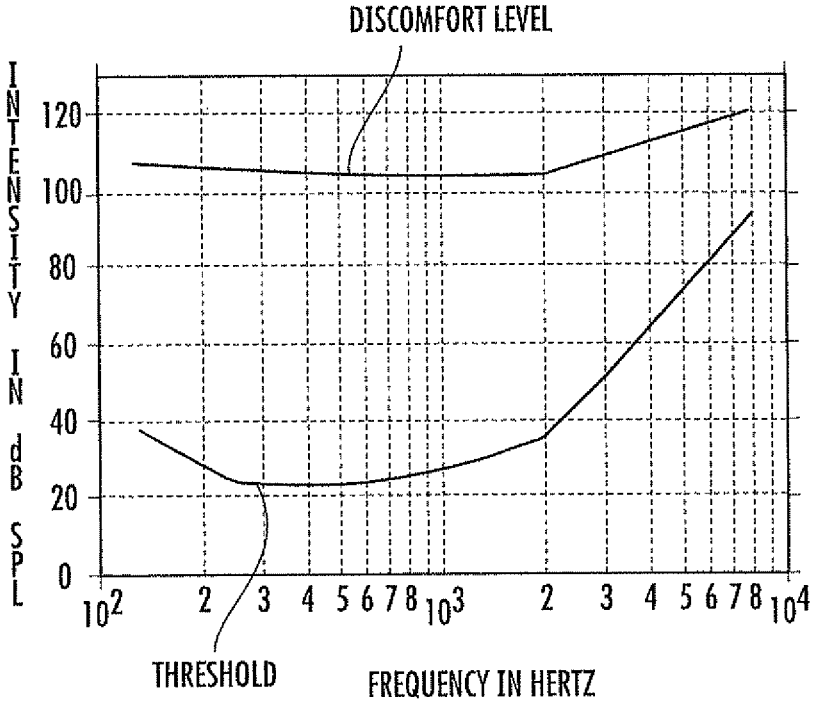
FIG. 6 is a typical threshold of hearing and discomfort for an ear with some hearing loss.

FIG. 6 shows the same two curves when a person has hearing loss, but there are many different types of hearing loss. Typically, the threshold of hearing becomes higher for different types of hearing loss and for a normal ear, but the threshold of discomfort increases or is unchanged. At high intensities, the loudness at any frequency is typically the same for those with and without hearing loss, i.e., commonly referred to as loudness recruitment. The filters as described can be used with those type of more simple hearing aids that provide linear amplification, with frequency-dependent gain, and those type of hearing aids that compress the dynamic range of sound at any frequency to fit a reduced dynamic range because of the hearing loss. Thus, complicated filters that are used to filter a speech signal to a number of bands can include the RF and EMI filters as described for multiband compression systems.

Different types of amplifiers can be used such as classes A, B, D, sliding class A, class H and other digital amplifiers. Different types of compression circuits including an output limiting compression that has a high compression knee point; a dynamic range compression that compresses input levels into a narrow dynamic range using a low knee point; a multichannel compression having different compression ratios and knee points for the frequencies between 500-2,000 Hz and high knee points and ratios of output limiting applied for frequencies above 2,000 Hz; BILL in which low frequencies increase at quiet intensity levels and reduce at high intensity levels; TILL that is the opposite of BILL where high frequencies increase at low levels and reduce at high levels; and PILL in which programmable instruments reduce either lows, highs, or both lows and highs and are a combination of both BILL and TILL. Different types of digital processing circuits can be used.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A hearing aid comprising:

a microphone, a speaker, and an audio circuit coupled therebetween;

said microphone having at least one microphone bias input;

said audio circuit comprising at least one microphone bias connection line coupled to said at least one microphone bias input; and at least one radio frequency (RF) filter coupled to said at least one microphone bias connection line.

2. The hearing aid according to claim 1, wherein said audio circuit further comprises at least one audio connection line between said microphone and said speaker; and further comprising at least one additional RF filter coupled to said at least one audio connection line.

3. The hearing aid according to claim 2, wherein said at least one RF filter is serially coupled with said at least one microphone bias connection line; and wherein said at least one additional RF filter is serially coupled with said at least one audio connection line.

4. The hearing aid according to claim 2, wherein said at least one RF filter comprises at least one ferrite inductor; and wherein said at least one additional RF filter comprises at least one additional ferrite inductor.

5. The hearing aid according to claim 4, wherein said at least one ferrite inductor comprises at least one ferrite bead; and wherein said at least one additional ferrite inductor comprises at least one additional ferrite bead.

6. The hearing aid according to claim 2, wherein said at least one RF filter comprises at least one LC filter; and wherein said at least one additional filter comprises at least one additional LC filter.

7. The hearing aid according to claim 1, further comprising at least one RF shield surrounding at least one of said speaker and microphone.

8. The hearing aid according to claim 7, wherein said at least one RF shield comprises at least one metallic housing.

9. The hearing aid according to claim 1, further comprising a hearing aid housing supporting said microphone, speaker and audio circuitry.

10. The hearing aid according to claim 9, further comprising a tone hook coupled to said hearing aid housing, and an earmold coupled to said tone hook.

11. The hearing aid according to claim 1, wherein said audio circuitry comprises a processor coupled to said at least one microphone bias connection line.

12. A hearing aid comprising:

a hearing aid housing;

a microphone, a speaker, and an audio circuit carried by said hearing aid housing, said audio circuit coupled between said microphone and speaker;

said microphone having at least one microphone bias input;

said audio circuit comprising at least one microphone bias connection line coupled to said at least one microphone bias input, and at least one audio connection line between said microphone and said speaker;

at least one radio frequency (RF) filter coupled to said at least one microphone bias connection line; and at least one additional RF filter coupled to said at least one audio connection line.

13. The hearing aid according to claim 12, wherein said at least one RF filter is serially coupled with said at least one microphone bias connection line; and wherein said at least one additional RF filter is serially coupled with said at least one audio connection line.

14. The hearing aid according to claim 12, wherein said at least one RF filter comprises at least one ferrite inductor; and wherein said at least one additional RF filter comprises at least one additional ferrite inductor.

15. The hearing aid according to claim 14, wherein said at least one ferrite inductor comprises at least one ferrite bead; and wherein said at least one additional ferrite inductor comprises at least one additional ferrite bead.

16. The hearing aid according to claim 12, wherein said at least one RF filter comprises at least one LC filter; and wherein said at least one additional filter comprises at least one additional LC filter.

17. The hearing aid according to claim 12, further comprising at least one RF shield surrounding at least one of said speaker and microphone.

18. The hearing aid according to claim 12, wherein said audio circuitry comprises a processor coupled to said at least one microphone bias connection line.

19. A method for enhancing immunity to RF interference in a hearing aid comprising a microphone, a speaker, and an audio circuit coupled therebetween; the microphone having at least one microphone bias input; the audio circuit comprising at least one microphone bias connection line coupled to the at least one microphone bias input; the method comprising:

coupling at least one radio frequency (RF) filter to the at least one microphone bias connection line.

20. The method according to claim 19, wherein the audio circuit further comprises at least one audio connection line between the microphone and the speaker; and further comprising coupling at least one additional RF filter to the at least one audio connection line.

21. The method according to claim 20, wherein coupling the at least one RF filter comprises serially coupling the at least one RF filter with the at least one microphone bias connection line; and wherein coupling the at least one additional RF filter comprises serially coupling the at least one additional RF filter with the at least one microphone bias connection line.

22. The method according to claim 20, wherein the at least one RF filter comprises at least one ferrite inductor; and wherein the at least one additional RF filter comprises at least one additional ferrite inductor.

23. The method according to claim 22, wherein the at least one ferrite inductor comprises at least one ferrite bead; and wherein the at least one additional ferrite inductor comprises at least one additional ferrite bead.

24. The method according to claim 20, wherein the at least one RF filter comprises at least one LC filter; and wherein the at least one additional filter comprises at least one additional LC filter.

25. The method according to claim 19, further comprising positioning at least one RF shield surrounding at least one of the speaker and microphone.

26. The method according to claim 19, wherein the audio circuitry comprises a processor coupled to the at least one microphone bias connection line.

* * * * *